US008463605B2

(12) United States Patent
Oh et al.

(10) Patent No.: US 8,463,605 B2
(45) Date of Patent: Jun. 11, 2013

(54) METHOD AND AN APPARATUS FOR DECODING AN AUDIO SIGNAL

(75) Inventors: Hyen-O Oh, Seoul (KR); Yang Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 826 days.

(21) Appl. No.: 12/522,250

(22) PCT Filed: Jan. 7, 2008

(86) PCT No.: PCT/KR2008/000073

§ 371 (c)(1),
(2), (4) Date: Jan. 8, 2010

(87) PCT Pub. No.: WO2008/082276

PCT Pub. Date: Jul. 10, 2008

(65) Prior Publication Data

US 2010/0145711 A1 Jun. 10, 2010

Related U.S. Application Data

(60) Provisional application No. 60/883,569, filed on Jan. 5, 2007, provisional application No. 60/884,043, filed on Jan. 9, 2007, provisional application No. 60/885,347, filed on Jan. 17, 2007.

(51) Int. Cl.

| | |
|---|---|
| ***G10L 19/00*** | (2006.01) |
| ***G10L 11/00*** | (2006.01) |
| ***H04R 5/00*** | (2006.01) |

(52) U.S. Cl.
USPC ..... 704/230; 704/200; 704/200.1; 381/17; 381/22

(58) Field of Classification Search
USPC ..... 381/17, 22; 704/200, 200.1, 230
See application file for complete search history.

(56) References Cited

U.S. PATENT DOCUMENTS 5,590,204 A 12/1996 Lee
5,812,674 A * 9/1998 Jot et al. ..... 381/17

(Continued)

FOREIGN PATENT DOCUMENTS

EP 1 640 972 A1 3/2006
JP 4-15693 A 1/1992

(Continued)

OTHER PUBLICATIONS

Breebaart, J., "Multi-Channel Goes Mobile: MPEG Surround Binaural Rendering," AES International Conference, Audio for Mobile and Handheld Devices, pp. 1-13, Sep. 2, 2006.
Faller, C., "Parametric Joing-Coding of Audio Sources." AES, 120th Convention, vol. 2, pp. 2-3, May 20, 2006.

(Continued)

*Primary Examiner* — Eric Yen
(74) *Attorney, Agent, or Firm* — Birch, Stewart, Kolasch & Birch, LLP

(57) ABSTRACT

A method of processing an audio signal is disclosed. The present invention includes receiving downmix information, object information and mix information, generating and transferring multi-channel information using at least one of the downmix information, the object information and the mix information, and selectively generating and transferring either first gain information or extra multi-channel information including second gain information in accordance with a decoding mode using at least one of the object information and the mix information.

16 Claims, 4 Drawing Sheets

U.S. PATENT DOCUMENTS

| | | | | |
|---|---|---|---|---|
| 6,408,268 | B1 * | 6/2002 | Tasaki | 704/220 |
| 7,035,417 | B1 * | 4/2006 | Packard | 381/94.1 |
| 7,050,968 | B1 * | 5/2006 | Murashima | 704/208 |
| 7,415,120 | B1 * | 8/2008 | Vaudrey et al. | 381/109 |
| 7,447,317 | B2 * | 11/2008 | Herre et al. | 381/23 |
| 7,756,713 | B2 * | 7/2010 | Chong et al. | 704/500 |
| 7,930,184 | B2 * | 4/2011 | Fejzo | 704/500 |
| 7,937,272 | B2 * | 5/2011 | Oomen et al. | 704/500 |
| 7,957,960 | B2 * | 6/2011 | Chen | 704/211 |
| 7,983,922 | B2 * | 7/2011 | Neusinger et al. | 704/500 |
| 8,073,169 | B2 * | 12/2011 | Rosen | 381/307 |
| 8,073,702 | B2 * | 12/2011 | Pang et al. | 704/500 |
| 2001/0055398 | A1 | 12/2001 | Pachet et al. | |
| 2005/0074127 | A1 * | 4/2005 | Herre et al. | 381/20 |
| 2005/0195981 | A1 | 9/2005 | Faller et al. | |
| 2006/0072768 | A1 * | 4/2006 | Schwartz et al. | 381/94.1 |
| 2006/0085200 | A1 | 4/2006 | Allamanche et al. | |
| 2007/0160219 | A1 * | 7/2007 | Jakka et al. | 381/22 |

FOREIGN PATENT DOCUMENTS

| | | | |
|---|---|---|---|
| JP | 6-78400 | A | 3/1994 |
| JP | 2001-306081 | A | 11/2001 |
| JP | 2003-9296 | A | 1/2003 |
| JP | 2005-109914 | A | 4/2005 |
| JP | 2008-522244 | A | 6/2008 |
| WO | WO-2005/063476 | A1 | 7/2005 |
| WO | WO-2006/008683 | A1 | 1/2006 |
| WO | WO 2006/060279 | A1 | 6/2006 |
| WO | WO-2006/132857 | A2 | 12/2006 |
| WO | WO 2007/080224 | A1 | 7/2007 |
| WO | WO 2007/080225 | A1 | 7/2007 |

OTHER PUBLICATIONS

Villemoes, L., et al., "MPEG Surround: The Forthcoming ISO Standard For Spatial Audio Coding," Proceedings of the International AES Conference, pp. 1-18, Jun. 30, 2006.

* cited by examiner

METHOD AND AN APPARATUS FOR DECODING AN AUDIO SIGNAL

This application is the National Phase of PCT/KR2008/000073 filed on Jan. 7, 2008, which claims priority under 35 U.S.C. 119(e) to U.S. Provisional Application No. 60/883,569, 60/884,043 and 60/885,347 filed on Jan. 5, 2007, Jan. 9, 2007 and Jan. 17, 2007; respectively, all of which are hereby expressly incorporated by reference into the present application.

FIELD OF THE INVENTION

The present invention relates to an apparatus for processing an audio signal and method thereof. Although the present invention is suitable for a wide scope of applications, it is particularly suitable for processing an audio signal received on a digital medium, a broadcast signal or the like.

BACKGROUND ART

Generally, while downmixing several audio objects to be a mono or stereo signal, parameters from the individual object signals can be extracted. These parameters can be used in a decoder of an audio signal, and positioning/panning of the individual sources can be controlled by user' selection.

However, in order to control each object signal, sources included in downmix need to be appropriately positioned or panned.

Moreover, in order to provide backward compatibility with a channel-oriented decoding scheme, an object parameter should be flexibly converted to a multi-channel parameter.

SUMMARY OF THE INVENTION

Accordingly, the present invention is directed to an apparatus for processing an audio signal and method thereof that substantially obviate one or more of the problems due to limitations and disadvantages of the related art.

An object of the present invention is to provide an apparatus for processing an audio signal and method thereof, by which gain and panning of an object can be controlled without restriction.

Another object of the present invention is to provide an apparatus for processing an audio signal and method thereof, by which gain and panning of an object can be controlled based on a selection made by a user.

Accordingly, the present invention provides the following effects or advantages.

First of all, according to the present invention, gain and panning of an object can be controlled without restriction.

Secondly, according to the present invention, gain and panning of an object can be controlled based on a selection made by a user.

Thirdly, according to the present invention, gain and panning of an object can be controlled no matter what a downmix signal is a mono signal or a stereo signal.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

Figure 1:
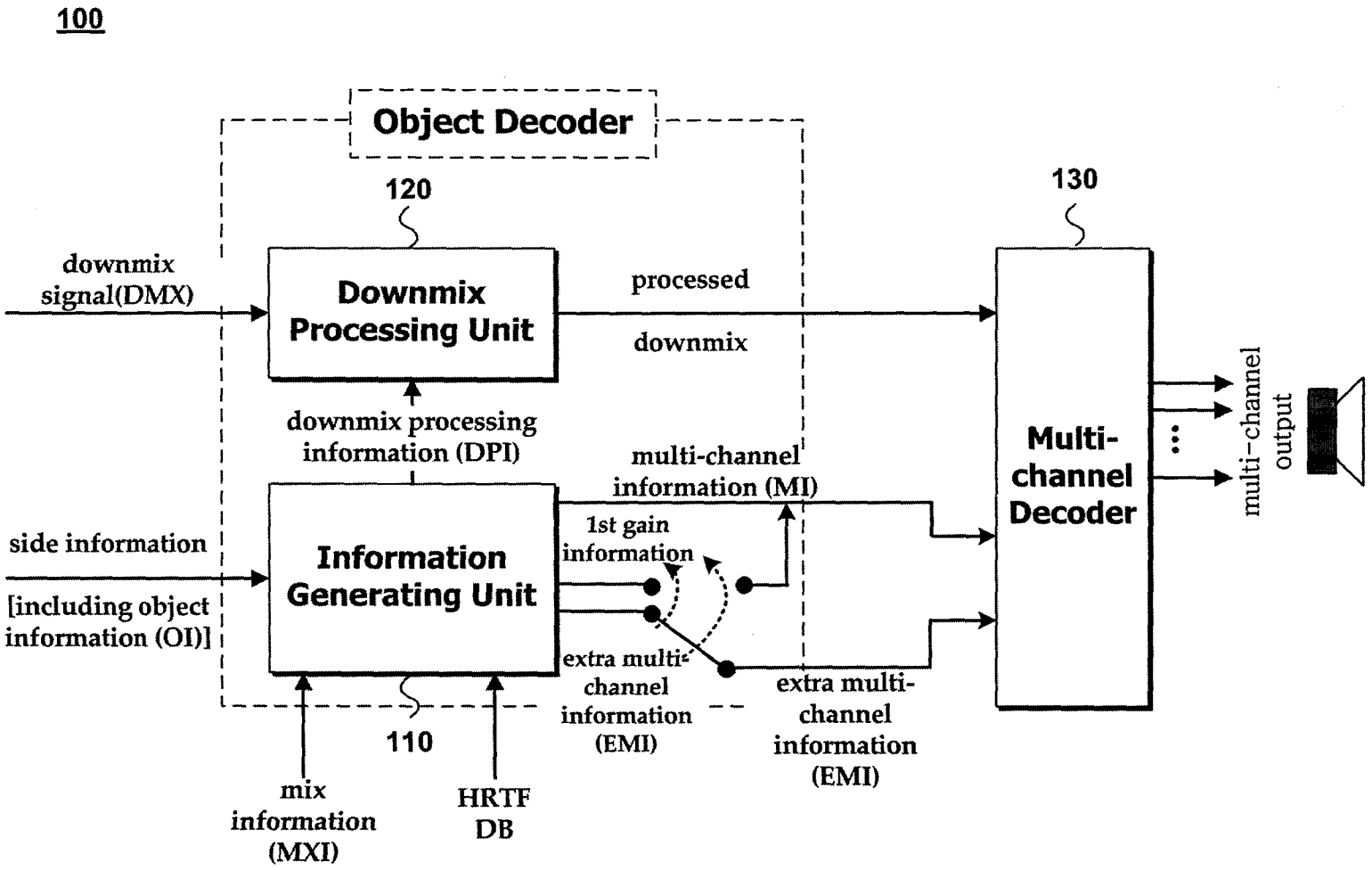
FIG. 1 is a block diagram of an audio signal processing apparatus according to an embodiment of the present invention.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method of processing an audio signal according to the present invention includes receiving downmix information, object information and mix information, generating and transferring multi-channel information using at least one of the downmix information, the object information and the mix information, and selectively generating and transferring either first gain information or extra multi-channel information including second gain information in accordance with a decoding mode using at least one of the object information and the mix information.

According to the present invention, the method can further include generating a multi-channel audio using either the first gain information or the extra multi-channel information including the second gain information, the multi-channel information and the downmix information.

According to the present invention, the object information includes at least one of object level information and object correlation information.

According to the present invention, the multi-channel information corresponds to information for upmixing the downmix signal into the multi-channel signal and the multi-channel information is generated using the object information and the mix information.

According to the present invention, the multi-channel information includes at least one of channel level information and channel correlation information.

According to the present invention, the first gain information is calculated per a time-subband variant.

According to the present invention, the first gain information indicates a ratio of a user gain calculated based on the object information and the mix information to an object level calculated from the object information.

According to the present invention, the multi-channel information and the first gain information are transferred together.

According to the present invention, the extra multi-channel information corresponds to HRTF information for binaural.

According to the present invention, generating either the first gain information or the extra multi-channel information includes if the decoding mode is not a binaural mode, generating the first gain information and if the decoding mode is the binaural mode, generating the extra multi-channel information.

According to the present invention, the HRTF information includes HRTF parameter and the object information.

According to the present invention, the HRTF parameter corresponds to a parameter extracted from an HRTF database.

According to the present invention, the second gain information corresponds to information for controlling a per-object level and the second gain information is generated based on the mix information.

According to the present invention, if the downmix signal corresponds to a mono signal, the method further includes bypassing the downmix signal, wherein in generating either the first gain information or the extra multi-channel information, if the decoding mode is not a binaural mode, the first gain information is generated and wherein in generating either the first gain information or the extra multi-channel information, if the decoding mode is the binaural mode, the extra multi-channel information is generated.

According to the present invention, the method further includes if a channel number of the downmix signal is at least two, generating downmix processing information using at least one of the object information and the mix information and processing the downmix signal using the downmix processing information, wherein in generating either the first gain information or the extra multi-channel information, if the decoding mode is a binaural mode, the extra multi-channel information is generated.

According to the present invention, the mix information is generated based on at least one of object position information, object gain information and playback configuration information.

According to the present invention, the downmix signal is received via a broadcast signal.

According to the present invention, the downmix signal is received on a digital medium.

To further achieve these and other advantages and in accordance with the purpose of the present invention, a computer-readable recording medium according to the present invention includes a program recorded therein, wherein the program is provided for executing receiving downmix information, object information and mix information, generating and transferring multi-channel information using at least one of the downmix information, the object information and the mix information, and selectively generating and transferring either first gain information or extra multi-channel information including second gain information in accordance with a decoding mode using at least one of the object information and the mix information.

To further achieve these and other advantages and in accordance with the purpose of the present invention, an apparatus for processing an audio signal according to the present invention includes an information receiving unit receiving downmix information, object information and mix information, an information generating unit generating multi-channel information using at least one of the downmix information, the object information and the mix information, the information generating unit selectively generating either first gain information or extra multi-channel information including second gain information in accordance with a decoding mode using at least one of the object information and the mix information, and an information transferring unit transferring the multi-channel information, the information transferring unit transferring either the first gain information or the extra multi-channel information including the second gain information in accordance with the decoding mode.

It is to be understood that both the foregoing general description and the following detailed description are exemplary and explanatory and are intended to provide further explanation of the invention as claimed.

Reference will now be made in detail to the preferred embodiments of the present invention, examples of which are illustrated in the accompanying drawings.

In this disclosure, information means a terminology that covers values, parameters, coefficients, elements and the like overall. So, its meaning can be construed different for each case. This does not put limitation on the present invention.

And, a multi-channel audio signal of the present invention is to be understood as a concept that includes a channel signal having a stereo effect (3D effect, binaural effect) applied thereto as well as a 3-channel or higher signal.

FIG. 1 is a block diagram of an audio signal processing apparatus according to an embodiment of the present invention.

Referring to FIG. 1, an audio signal processing apparatus 100 according to an embodiment of the present invention includes an information generating unit 110, a downmix processing unit 120, and a multi-channel decoder 130.

The information generating unit 110 receives side information including object information and mix information. The information generating unit 110 generates first gain information or extra multi-channel information (EMI) using the received information. In this case, an extra multi-channel parameter (EMI) includes HRTF (head-related transfer functions) information for a binaural mode and second gain information. Meanwhile, details for the object information (OI), the mix information (MXI), the first gain information, the extra multi-channel information (EMI) and the like will be explained later with reference to FIG. 2. Moreover, in case of generating the first gain information, the information generating unit 110 transfers multi-channel information (MI) including the first gain information to the multi-channel decoder 130. In case of not generating the first gain information, the information generating unit 110 transfers multi-channel information (MI) excluding the first gain information and the extra multi-channel information (EMI) to the multi-channel decoder 130. Its details will be explained later with reference to FIG. 2. In addition, the information generating unit 110 is capable of generating downmix processing information (DPI) using the object information (OI) and the mix information (MXI).

The downmix processing unit 120 receives downmix information (hereinafter named 'downmix signal (DMX)') and then processes the downmix signal DMX using downmix processing information (DPI). In case that the downmix signal (DMX) corresponds to a mono signal, the downmix processing unit 120 bypasses the downmix signal (DMX) without processing it. In this case, in order to adjust a gain of the downmix signal (DMX), the information generating unit 110 is able to generate the first gain information. Meanwhile, in case that a channel number of the downmix signal (DMX) corresponds to at least two (i.e., the downmix signal is not a mono signal but a stereo or multi-channel signal), information for adjusting gain and panning of object may be included in the downmix processing information (DPI) or the extra multi-channel information (EMI) instead of being included in the first gain information. This will be explained in detail later.

The multi-channel decoder 130 receives a processed downmix. The multi-channel decoder 130 generates a multi-channel signal by upmixing the processed downmix signal using the multi-channel information (MI). In case that the extra multi-channel information (EMI) is received, the multi-channel decoder 30 modifies the multi-channel signal using the received extra multi-channel information (EMI).

Figure 2:
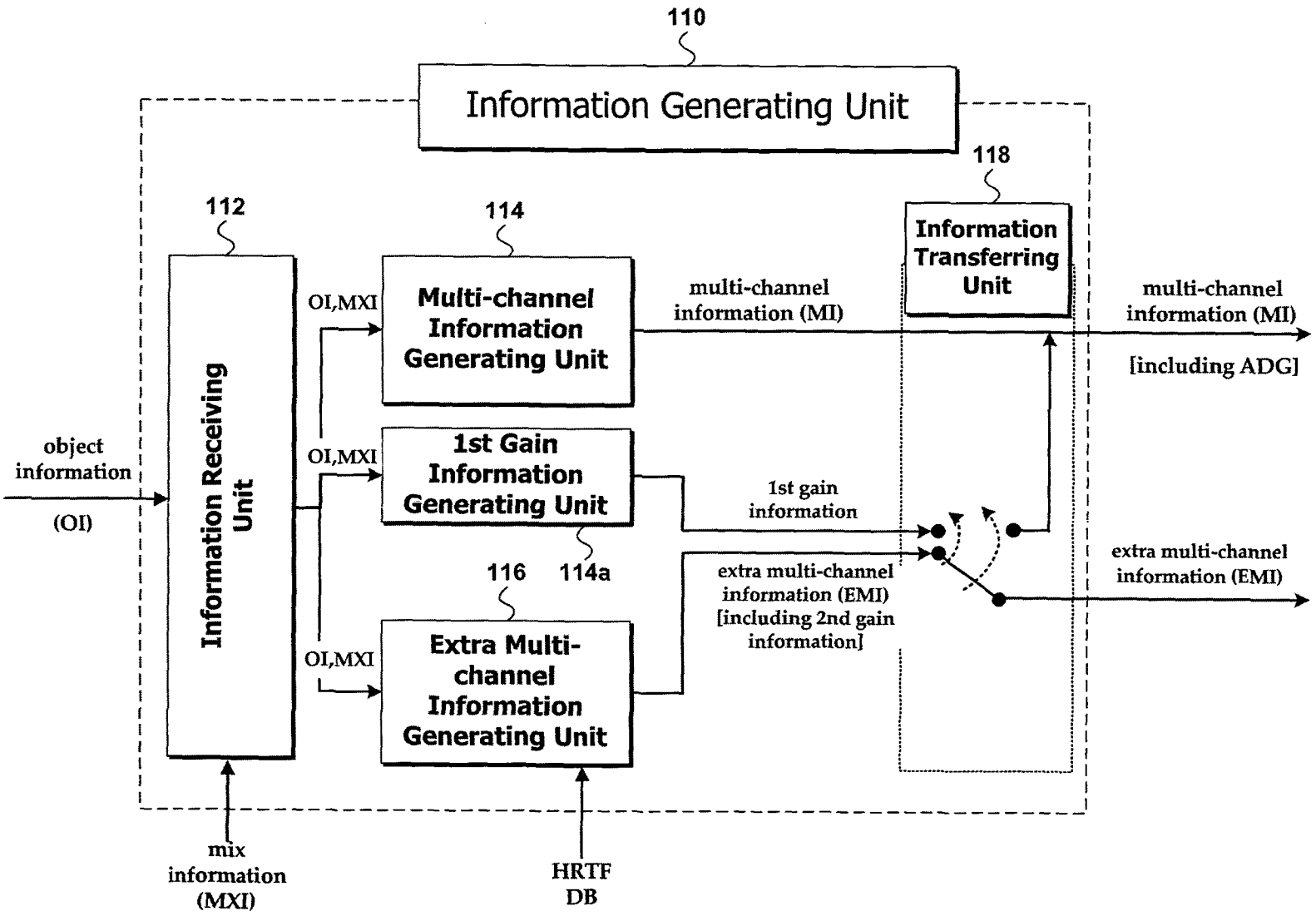
FIG. 2 is a detailed block diagram of an information generating unit of an audio signal processing apparatus according to an embodiment of the present invention.

FIG. 2 is a detailed block diagram of an information generating unit of an audio signal processing apparatus according to an embodiment of the present invention.

Referring to FIG. 2, an information generating unit 110 includes an information receiving unit 112, a multi-channel information generating unit 114, a first gain information generating unit 114a, an extra multi-channel information generating unit 116, and an information transferring unit 118. Meanwhile, the information generating unit 110 may include the information receiving unit 112 and the information transferring unit 118. Alternatively, the information receiving unit 112 and the information transferring unit 118 may correspond to elements configured separate from the information generating unit 110. Moreover, the multi-channel information generating unit 114 may include the first gain information generating unit 114*a*, which does not restrict various implementations of the present invention.

The information receiving unit 112 receives object information (OI) via a broadcast signal, a digital medium or the like. In this case, the object information (OI) may be the information extracted from the aforesaid side information. The object information (OI) is information on objects included within a downmix signal and may include object level information, object correlation information and the like. Meanwhile, the information receiving unit 112 receives mix information (MXI) via a user interface or the like. In this case, the mix information (MXI) is the information generated based on object position information, object gain information, playback configuration information and the like. In particular, the object position information is the information inputted for a user to control position or panning of each object. The object gain information is the information inputted for a user to control gain for each object. The playback configuration information is the information that includes the number of speakers, a position of each speaker, ambient information (virtual position of speaker) and the like. And, the playback configuration information can be inputted by a user, stored in advance or received from other devices.

The multi-channel information generating unit 114 generates multi-channel information (MI) using the object information (OI) and the mix information (MXI). In this case, the multi-channel information (MI) is the information for upmixing a downmix signal (DMX) and may include channel level information, channel correlation information and the like.

The first gain information generating unit 114*a* generates first gain information using the object information (OI) and the mix information (MXI). In this case, the first gain information is the information for modifying a gain of the downmix signal (DMX) and can be called a gain modifying factor or an arbitrary downmix gain (ADG). The first gain information can be represented as a ratio of a user gain estimated based on the object information (OI) and the mix information (MXI) to an object level estimated from the object information (OI). And, the first gain information can be calculated per a time-subband. If the first gain information is applied to the downmix signal (DMX), prior to upmixing the downmix signal (DMX), it is able to adjust a gain of the downmix signal per a specific time and per a specific frequency band. Hence, it is able to adjust a gain of each object according to user's control.

Meanwhile, in case that a downmix (DMX) is a mono signal, the first gain information generating unit 114*a* is able to generate first gain information. Furthermore, in case that a downmix signal (DMX) is a mono signal, when the extra multi-channel information generating unit 116 does not generate HRTF information for a binaural mode, the first gain information generating unit 114*a* is able to generate first gain information. In case that HTRF information for a binaural mode is generated, second gain information for adjusting an object gain can be included within the HRTF information. So, if the first gain information for adjusting a gain of object is generated, generation and transport of gain information may be overlapped. Details for the binaural mode and the like will be explained later together with the extra multi-channel generating unit 116.

The extra multi-channel generating unit 116 generates extra multi-channel information (EMI) using object information (OI), mix information (MXI) and an HRTF database. The extra multi-channel information (EMI) may include HTRF information for binaural mode. In this case, the binaural mode is a processing mode for 3-dimensional stereo sound in a channel-oriented decoding scheme (e.g., MPEG Surround).

Meanwhile, the HRTF information may include: 1) second gain information; 2) HRTF parameter; and 3) object information. In this case, the second gain information is the information for controlling a object gain and may be estimated based on mix information (MXI). And, the HRTF parameter may be the parameter extracted from the HTRF database. Since it is able to independently use the HRTF information for each decoder, an audio signal can be effectively decoded using the HRTF information. The object information may be object information (OI) received via the information receiving unit 112.

Besides, it is able to assume that objects signals are controlled in a manner of Formula 1.

$$L_{new}=a_1\times\text{obj}_1+a_2\times\text{obj}_2+a_3\times\text{obj}_3+\ldots+a_n\times\text{obj}_n, \quad \text{[Formula 1]}$$

$$R_{new}=b_1\times\text{obj}_1+b_2\times\text{obj}_2+b_3\times\text{obj}_3+\ldots+b_n\times\text{obj}_n$$

In this case, $L_{new}$ and $R_{new}$ indicate signals desired by a user. And, $\text{Obj}_k$ indicate information representing characteristic (energy, correlation, etc.) of object and may be the information extracted from the aforesaid object information (OI). Moreover, $a_k$ and $b_k$ are coefficients for object control and may be the information extracted mix information (MXI) inputted by a user. To correspond to $a_k$ and $b_k$, the first gain information or the HRTF parameter can be set.

In particular, Formula 1 can be represented as Formula 2 as well.

$$L_{new}=\Sigma HRTF\times ch \quad \text{[Formula 2]}$$

In this case, 'HRTF' indicates an HRTF parameter and 'ch' indicates a channel signal.

Besides, the following is possible.

$$L_{new}=\Sigma H\tilde{R}\tilde{T}F\times ch \quad \text{[Formula 3]}$$

In this case, is a factor to adjust a gain and may correspond to second gain information.

Meanwhile, in the MPEG Surround standard (5-1-$5_1$ configuration) (from ISO/IEC FDIS 23003-1:2006(E), Information Technology—MPEG Audio Technologies—Part1: MPEG Surround), binaural processing can be represented as follows.

$$\begin{aligned} y_B^{n,k} &= \begin{bmatrix} y_{L_B}^{n,k} \\ y_{R_B}^{n,k} \end{bmatrix} \\ &= H_2^{n,k}\begin{bmatrix} y_m^{n,k} \\ D(y_m^{n,k}) \end{bmatrix} \\ &= \begin{bmatrix} h_{11}^{n,k} & h_{12}^{n,k} \\ h_{21}^{n,k} & h_{22}^{n,k} \end{bmatrix}\begin{bmatrix} y_m^{n,k} \\ D(y_m^{n,k}) \end{bmatrix}, 0 \le k < K \end{aligned} \quad \text{[Formula 4]}$$

In this case, '$y_B$' is an output signal and a matrix H is a transform matrix for performing a binaural processing.

And, the matrix H can be expressed as follows.

$$H_1^{l,m} = \begin{bmatrix} h_{11}^{l,m} & h_{12}^{l,m} \\ h_{21}^{l,m} & -(h_{12}^{l,m})^* \end{bmatrix}, 0 \le m < M_{Proc}, 0 \le l < L \quad \text{[Formula 5]}$$

Each component of the matrix H can be defined as follows.

$$h_{11}^{l,m} = \sigma_L^{l,m}(\cos(IPD_B^{l,m}/2) + j\sin(IPD_B^{l,m}/2))(iid^{l,m} + ICC_B^{l,m})d^{l,m}, \quad \text{[Formula 6]}$$

$$h_{12}^{l,m} = \frac{\sigma_L^{l,m}(\cos(IPD_B^{l,m}/2) + j\sin(IPD_B^{l,m}/2))}{\sqrt{1((iid^{l,m} + ICC_B^{l,m})d^{l,m})^2}}$$

$$h_{21}^{l,m} = \sigma_R^{l,m}(\cos(IPD_B^{l,m}/2) - j\sin(IPD_B^{l,m}/2))(1 + iid^{l,m}ICC_B^{l,m})d^{l,m}$$

$$\begin{aligned}(\sigma_X^{l,m})^2 = {} & (P_{X,C}^n)^2(\sigma_C^{l,m})^2 + (P_{X,L}^n)^2(\sigma_L^{l,m})^2 + \\ & (P_{X,Ls}^n)^2(\sigma_{Ls}^{l,m})^2 + (P_{X,R}^n)^2(\sigma_R^{l,m})^2 + (P_{X,Rs}^n)^2(\sigma_{Rs}^{l,m})^2 + \\ & \ldots P_{X,L}^n P_{X,R}^n \rho_L^m \sigma_L^{l,m} \sigma_R^{l,m} ICC_3^{l,m} \cos(\phi_L^m) + \\ & \ldots P_{X,L}^n P_{X,R}^n \rho_R^m \sigma_L^{l,m} \sigma_R^{l,m} ICC_3^{l,m} \cos(\phi_R^m) + \\ & \ldots P_{X,Ls}^n P_{X,Rs}^n \rho_{Ls}^m \sigma_{Ls}^{l,m} \sigma_{Rs}^{l,m} ICC_2^{l,m} \cos(\phi_{Ls}^m) + \\ & \ldots P_{X,Ls}^n P_{X,Rs}^n \rho_{Rs}^m \sigma_{Ls}^{l,m} \sigma_{Rs}^{l,m} ICC_2^{l,m} \cos(\phi_{Rs}^m)\end{aligned} \quad \text{[Formula 7]}$$

$$\begin{aligned}(\sigma_L^{l,m})^2 &= r_1(CLD_0^{l,m})r_1(CLD_1^{l,m})r_1(CLD_3^{l,m}) \\ (\sigma_R^{l,m})^2 &= r_1(CLD_0^{l,m})r_1(CLD_1^{l,m})r_2(CLD_3^{l,m}) \\ (\sigma_C^{l,m})^2 &= r_1(CLD_0^{l,m})r_2(CLD_1^{l,m})/g_c^2 \\ (\sigma_{Ls}^{l,m})^2 &= r_2(CLD_0^{l,m})r_1(CLD_2^{l,m})/g_s^2 \\ (\sigma_{Rs}^{l,m})^2 &= r_2(CLD_0^{l,m})r_2(CLD_2^{l,m})/g_s^2 \\ \text{with } r_1(CLD) &= \frac{10^{CLD/10}}{1 + 10^{CLD/10}} \\ \text{and } r_2(CLD) &= \frac{1}{1 + 10^{CLD/10}}.\end{aligned} \quad \text{[Formula8]}$$

In Formula 7, '$P_{X,C}$', '$P_{X,L}$' and the like are factors corresponding to HTRF parameters and can correspond to the second gain information in Formula 3. And, '$\sigma_C$', '$\sigma_L$' and the like in Formula 7 are factors indicating channel power and can correspond to the object power in Formula 1. Thus, since the correspondent relation is effected, it is able to generate a signal specified by a user using the HRTF parameters. In other words, it is able to generate output by applying HRTF parameter to value corresponding to each channel given by the Formulas.

The information transferring unit 118 transfers multi-channel information (MI) and also transfers either the first gain information or the extra multi-channel information (EMI). In particular, in case that the first gain information is generated by the first gain information generating unit 114*a*, the information transferring unit 118 transfers the multi-channel information including the first gain information. In case that the extra multi-channel information (EMI) is generated by the extra multi-channel information generating unit 116, the information transferring unit 118 transfers the multi-channel information (MI) excluding the first gain information and the extra multi-channel information (EMI). In this case, it is to be understood that it is able to transfer the first gain information of default instead of excluding the first gain information from the multi-channel information (MI).

Meanwhile, in case that the extra multi-channel information (EMI) including the HRTF information is transferred, the information transferring unit 118 transfers a specific HRTF parameter once and is then able to transfer information (e.g., index) capable of identifying the specific HRTF parameter.

After a bit stream matching a syntax of a channel-oriented standard (e.g., MPEG Surround) has been generated using the multi-channel information (MI) and the first gain information, the information transferring until 118 is able to transfer the generated bit stream. This does not put limitation on various implementations of the present invention.

Figure 3:
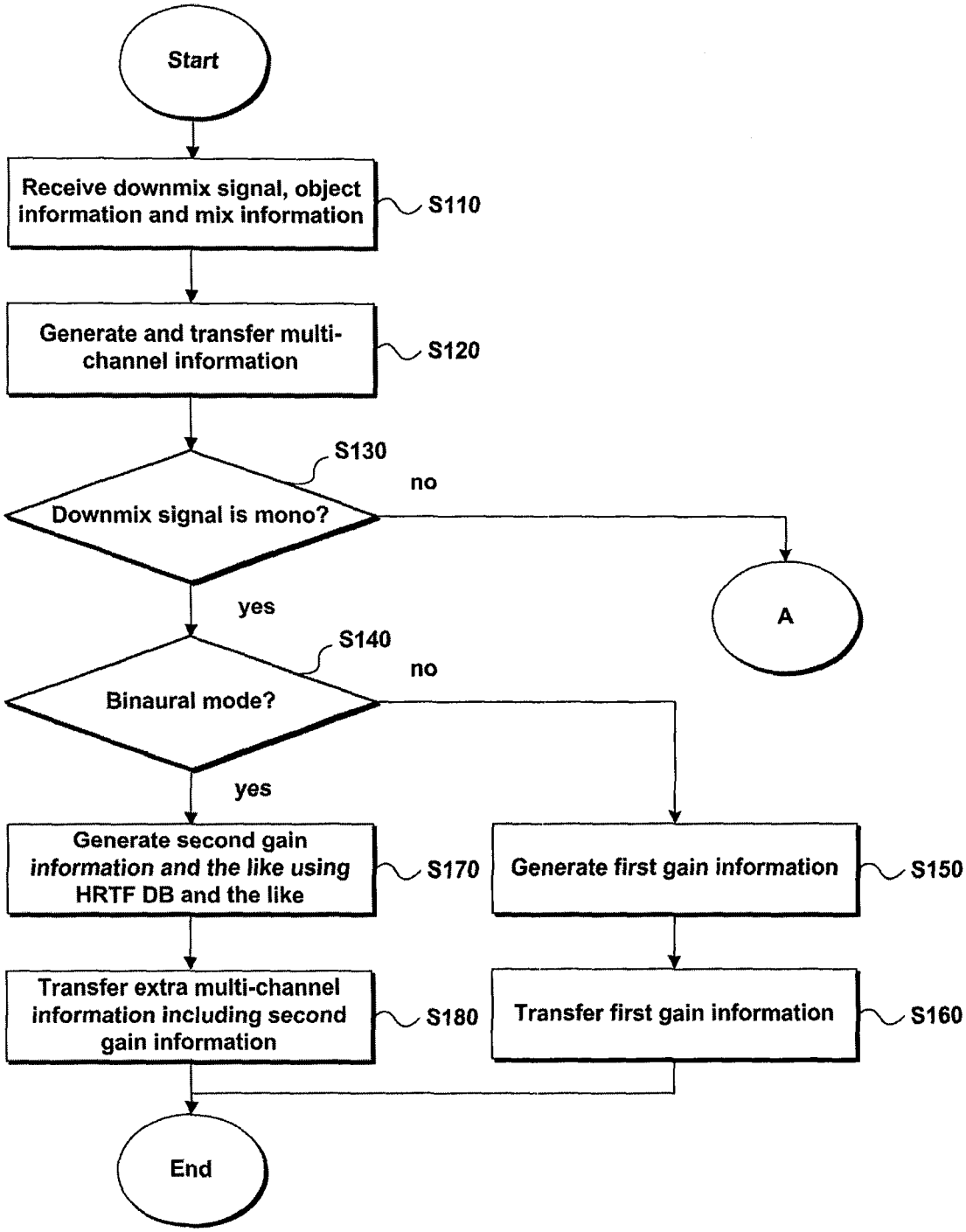
FIG. 3 and FIG. 4 are flowcharts for an audio signal processing method according to an embodiment of the present invention.

FIG. 3 is a flowchart for an audio signal processing method according to an embodiment of the present invention.

Figure 4:
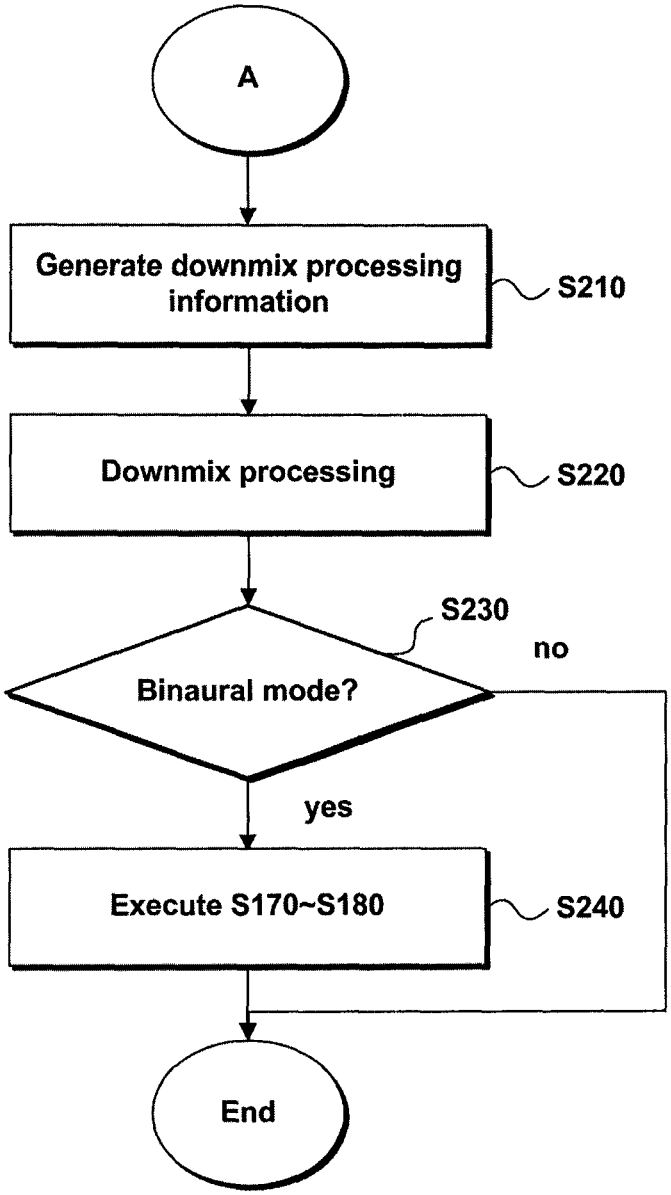

Referring to FIG. 3, a downmix signal (DMX), object information (OI) and mix information (MXI) are received [S110]. Multi-channel information is generated and then transferred using the object information (OI) and the mix information (MXI) [S120]. If the downmix signal is not a mono signal ('no' in the step S130) (i.e., the downmix signal is a stereo signal), steps S210 to S240 are executed. This will be explained in detail later with reference to FIG. 4. In case that first gain information is generated regardless of whether the downmix signal is a mono signal or a stereo signal, it is a matter of course that the step S130 and the steps S210 to S240 can be omitted.

Meanwhile, in case that the downmix signal is the mono signal ('yes' in the step S130), it is decided whether information for a binaural mode will be generated or not [S140]. If the information for the binaural mode is not to be generated ('no' in the step S140), first gain information is generated for controlling an object gain [S150]. Subsequently, multi-channel information (MI) including the first gain information is transferred [S170]. In this case, the first gain information can be transferred together with the multi-channel information of the step S120. A multi-channel decoder receives the multi-channel information and is then able to control a gain of the downmix signal by applying the received multi-channel information.

In case that the information for the binaural mode is generated in the step S140 ('yes' in the step S140), HTRF information including second gain information, HRTF parameter and object parameter is generated using object information, mix information, HRTF database and the like [S170]. Subsequently, extra multi-channel information (EMI) including the second gain information is transferred [S180].

In case that the downmix signal is not the mono signal in the step S130, downmix processing information is preferentially generated using the object information (OI) and the mix information (MXI) [S210]. A downmix is processed using the downmix processing information (DPI) generated in the step S210 [S220]. In case of the binaural mode ('yes' in the step S230), the aforesaid steps S170 and S180 are executed. If it is not the binaural mode ('no' in the step S230), all procedures are ended.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

Accordingly, the present invention is applicable to a process for encoding/decoding an audio signal.

What is claimed is:

1. A method of processing an audio signal, the method comprising:

receiving, via an information receiving unit, a downmix signal generated by downmixing at least one object, object information indicating attributes of the at least one object included in the downmix signal, and mix information;

generating, via an information generating unit, multi-channel information using at least one of the object information and the mix information;

generating, via the information generating unit, first gain information or extra multi-channel information including second gain information by using at least one of the object information and the mix information, according to a decoding mode; and generating, via a multi-channel decoder, a multi-channel signal by using the downmix signal, the multi-channel information, and the one of the first gain information and the extra multi-channel information, wherein the multi-channel information is used to upmix the downmix signal to the multi-channel signal, and wherein the first gain information indicates a ratio of a user gain calculated based on the object information and the mix information to an object level calculated from the object information.

2. The method of claim 1, wherein the object information includes at least one of object level information and object correlation information.

3. The method of claim 1, wherein the multi-channel information includes at least one of channel level information and channel correlation information.

4. The method of claim 1, wherein the first gain information is calculated per a subband within a time slot.

5. The method of claim 1, wherein the multi-channel information and the first gain information are transferred together.

6. The method of claim 1, wherein the extra multi-channel information corresponds to HRTF information for binaural.

7. The method of claim 6, wherein generating the first gain information or the extra multi-channel information comprises:

if the decoding mode is not a binaural mode, generating the first gain information; and if the decoding mode is the binaural mode, generating the extra multi-channel information.

8. The method of claim 6, wherein the HRTF information includes HRTF parameter and the object information.

9. The method of claim 8, wherein the HRTF parameter corresponds to a parameter extracted from an HRTF database.

10. The method of claim 1, wherein the second gain information corresponds to information for controlling an object level, and the second gain information is generated based on the mix information.

11. The method of claim 1, wherein if the downmix signal corresponds to a mono signal, the method further comprises bypassing the downmix signal, wherein the generating the first gain information or the extra multi-channel information comprises:

if the decoding mode is not a binaural mode, generating the first gain information and if the decoding mode is the binaural mode, generating the extra multi-channel information.

12. The method of claim 1, further comprising:

if a channel number of the downmix signal is at least two, generating downmix processing information using at least one of the object information and the mix information; and processing the downmix signal using the downmix processing information, wherein the generating the first gain information or the extra multi-channel information comprises:

if the decoding mode is a binaural mode, generating the extra multi-channel information.

13. The method of claim 1, wherein the mix information is generated based on at least one of object position information, object gain information and playback configuration information.

14. The method of claim 1, wherein the downmix signal is received via a broadcast signal.

15. The method of claim 1, wherein the downmix signal is received from a digital medium.

16. An apparatus for processing an audio signal, the apparatus comprising:

an information receiving unit receiving a downmix signal generated by downmixing at least one object, object information indicating attributes of the at least one object included in the downmix signal, and mix information;

an information generating unit generating multi-channel information using at least one of the object information and the mix information, the information generating unit generating first gain information or extra multi-channel information including second gain information by using at least one of the object information and the mix information, according to a decoding mode; and a multi-channel decoder generating a multi-channel signal by using the downmix signal, the multi-channel information, and one of the first gain information and the extra multi-channel information, wherein the multi-channel information is used to upmix the downmix signal to the multi-channel signal, and wherein the first gain information indicates a ratio of a user gain calculated based on the object information and the mix information to an object level calculated from the object information.

* * * * *